US005610694A

United States Patent [19]

Lior et al.

[11] Patent Number: 5,610,694

[45] Date of Patent: Mar. 11, 1997

[54] LATENT DEVELOPMENT APPARATUS FOR USE IN ELECTROPHOTOGRAPHIC IMAGING SYSTEM

[75] Inventors: Ishaiau Lior, Ness Zlona; Amiran Lavon, Bat Yam; Ehud Chatow, Petach Tikva, all of Israel

[73] Assignee: Indigo N.V., SM Veldhoven, Netherlands

[21] Appl. No.: 464,851

[22] PCT Filed: Jan. 11, 1993

[86] PCT No.: PCT/NL93/00010

§ 371 Date: Aug. 17, 1995

§ 102(e) Date: Aug. 17, 1995

[87] PCT Pub. No.: WO94/16364

PCT Pub. Date: Jul. 21, 1994

[51] Int. Cl.[6] ..... G03G 15/10

[52] U.S. Cl. ..... 399/240

[58] Field of Search ..... 355/256; 188/661, 188/652

[56] References Cited

U.S. PATENT DOCUMENTS

| | | | |
|---|---|---|---|
| 3,921,579 | 11/1975 | Wright | 118/651 |
| 4,327,664 | 5/1982 | Ohkawa et al. | 118/661 |
| 4,400,079 | 8/1983 | Landa | 355/256 |
| 4,504,138 | 3/1985 | Kuehnle et al. | 355/256 |
| 4,684,238 | 8/1987 | Till et al. | 355/256 X |
| 4,974,027 | 11/1990 | Landa et al. | 355/256 |
| 4,984,025 | 1/1991 | Landa et al. | 355/274 |
| 4,999,677 | 3/1991 | Landa et al. | 355/273 |
| 5,028,964 | 7/1991 | Landa et al. | 355/273 |
| 5,047,808 | 9/1991 | Landa et al. | 355/277 |
| 5,089,856 | 2/1992 | Landa et al. | 355/279 |
| 5,436,706 | 7/1995 | Landa et al. | 355/256 |

FOREIGN PATENT DOCUMENTS

| | | |
|---|---|---|
| 990589 | 6/1976 | Canada . |
| 9004216 | 4/1990 | WIPO . |

*Primary Examiner*—Arthur T. Grimley
*Assistant Examiner*—Quana Grainger
*Attorney, Agent, or Firm*—Greenblum & Bernstein P.L.C.

[57] ABSTRACT

Imaging apparatus including:

an image-forming surface having formed thereon a latent electrostatic image, the latent electrostatic image including image regions at a first voltage and background regions at a second voltage;

a developer surface charged to a third voltage intermediate the first and second voltages and having a second surface urged against and adapted for operative engagement with the image-forming surface at a development region;

an applicator assembly operative to apply a layer of concentrated liquid toner comprising charged toner particles and carrier liquid onto the developer surface;

a developer operative to develop the latent image by transferring less than the total thickness of the layer of concentrated liquid toner from the developer surface to the image regions of the image-forming surface thereby to form a developed image on the image-forming surface; and apparatus for transferring the developed image from the image-forming surface to a final substrate.

23 Claims, 3 Drawing Sheets

LATENT DEVELOPMENT APPARATUS FOR USE IN ELECTROPHOTOGRAPHIC IMAGING SYSTEM

FIELD OF THE INVENTION

The present invention relates to development apparatus in general and, more particularly, to latent image development apparatus in electrophotographic imaging systems.

BACKGROUND OF THE INVENTION

The method of developing a latent image formed on a photoconductive surface by means of electrophoretic transfer of liquid toner is well known in the art. In this method, charged particles suspended in a non-polar insulating carrier liquid migrate under the influence of an electrostatic field and concentrate in an image forming configuration upon relatively charged or discharged areas of a photoconductive surface. The developed image is then transferred to a substrate, such as paper, either directly or by means of one or more intermediate transfer members.

In U.S. Pat. No. 4,504,138 a different method for the developing of a latent image is described. This patent describes applying a thin viscous high density layer of toner particles on the circumferential surface of a roller and bringing the layer so formed to the photoconductive surface. Transfer of selected portions of the toner layer onto the photoconductive surface then occurs due to the electric field induced by the latent image.

In Canadian Patent 990589, a method of developing electrostatic images is described which involves producing a film of liquid toner on a first applicator and bringing the applicator in contact with the final substrate which carries a latent image, thereby to develop the image. A second applicator bearing a layer of carrier liquid is then brought into contact with the substrate to remove background deposits and to squeegee out excess liquid. The film of liquid toner described in Canadian Patent 990589 has between 2–4 per cent of toner concentrate dispersed within the carrier liquid.

A latent image development apparatus described in U.S. Pat. No. 4,327,664 includes a porous, resilient sponge, development roller which is circumferentially surrounded by a net of fine mesh size. The developer roller is urged against the latent image carrying surface of a drum and liquid toner, which is carried in the roller is squeezed out of the compressed sponge through the fine net. Toner particles which are contained in the liquid toner are selectively deposited, by electrophoresis, onto the surface of the drum to form an image.

U.S. Pat. No. 4,400,079 describes a liquid toner development system for developing a latent image on a photoreceptor that uses a non-contacting developer roller. The development roller surface may move in the same direction as the photoreceptor surface or in the opposite direction.

Most of the above mentioned apparatus, as well as many other techniques which are known in the art, are concerned with producing a layer of toner on the surface of a developing roller and transferring the entire thickness of the layer to image of a latent image on an image bearing substrate. For such systems, the uniformity of the layer thickness is important, since this thickness determines the density of the image. Normally, it is very difficult to control the uniformity of the developing layer even by expensive and complicated means, especially when the layer thickness is generally a function of the previous imaging history of the apparatus.

SUMMARY OF THE INVENTION

It is an object of the present invention to provide simplified apparatus for the development of latent images in electrophotographic imaging systems by transfer of concentrated liquid toner, wherein the optical density of toner in the toned regions of the final image is substantially uniform.

In preferred embodiments of the present invention a developer roller, preferably made of resilient material, is urged against an image forming surface, such as a photoreceptor, that has an electrostatic latent image comprising image areas at a first voltage and background areas at a second voltage formed thereon. The developer roller is coated with a relatively thin film of concentrated liquid toner material having a given layer thickness. At least a portion of this layer thickness is selectively transferred to the image-forming surface in accordance with the latent image formed thereon.

According to one aspect of the invention, the developer is electrified to a voltage which is intermediate the first and second voltages. In a preferred embodiment of the invention, the developer voltage is selected to cause only a portion of the layer thickness to transfer to the image areas of the latent image. The present inventors have found that when the developer voltage is properly chosen, the density of toner particles per unit area (DMA) is less strongly dependent on the thickness of the toner concentrate layer on the developer roller or on the layer's solids concentration. Thus, even if the thickness of the layer on the developer roller varies by an unacceptable amount, the non-uniformity of the layer transferred to the image forming surface is improved at least by a factor of two.

In a second aspect of the invention, the thickness uniformity of the toner concentrate layer on the developer is improved by supplying the toner concentrate preferably from a sponge roller which is urged against the developer roller and which travels at a different speed from that of the developer roller at the point of contact between the two rollers. Increased uniformity results even if the toner concentrate remaining on the developer roller is not removed from the roller before application of a new layer of toner concentrate. When the applicator roller and developer rollers move at the same speed at the point of contact, there is a substantial "memory" of the prior image which non-uniformly effects the developed toner particle mass per unit area (DMA) in the layer on the developer roller.

In a preferred embodiment of the invention, the concentration of toner particles on the layer is increased by application of an electrified squeegee roller to the layer before the transfer to the imaging surface.

In a preferred embodiment of the invention, the applicator roller moves in a direction opposite to that of the developer roller at the point of contact between them.

In one preferred embodiment of the invention, the developer roller is coated by developing thereon a layer of toner particles by electrophoresis from liquid toner using a stationary plate type developer.

Preferably, the coating step is followed by squeegeeing the layer on the developer roller with a squeegee roller at a high voltage and with high pressure in order to remove a large portion of the liquid therein, before transfer of all or a portion of the resultant thickness of the layer to the image forming surface.

Further, material remaining on the developer roller after development of the latent image is preferably removed in a cleaning step before the recoating of the developer roller.

In a preferred embodiment of the invention, the developer roller may be cleaned by a tandem roller system in which a first, biased squeegee, roller removes the toner particles from the developer roller by electrostatic transfer. A second, sponge cleaning, roller removes the toner particles from the biased squeegee roller by abrasion, preferably aided by an electrostatic field. The toner is removed from the sponge roller by a blade which indents the surface of the sponge and scrapes the material which is extruded away. Preferably, one or both of the squeegee-developer or squeegee-sponge surfaces is wetted by a cleaning liquid or dilute toner to aid in transfer and removal of the toner particles. The toner so removed is preferably recycled and used for recoating the developer roller.

BRIEF DESCRIPTION OF THE DRAWINGS

The present invention will be understood and appreciated more fully from the following detailed description, taken in conjunction with the drawings in which.

DETAILED DESCRIPTION OF PREFERRED EMBODIMENTS.

Figure 1:
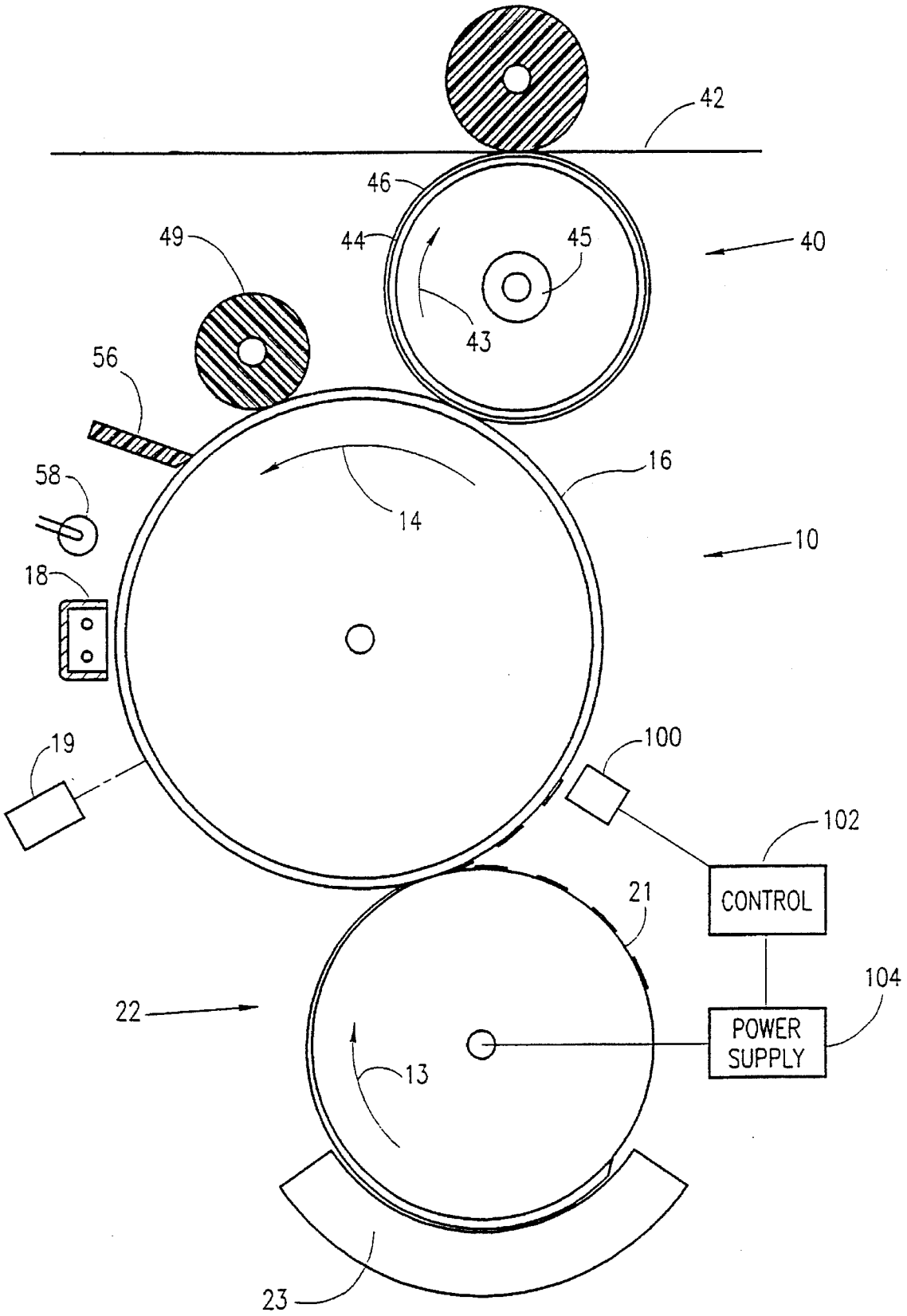
FIG. 1 is a schematic diagram of imaging apparatus constructed and operated in accordance with a preferred embodiment of the present invention.
Figure 2:
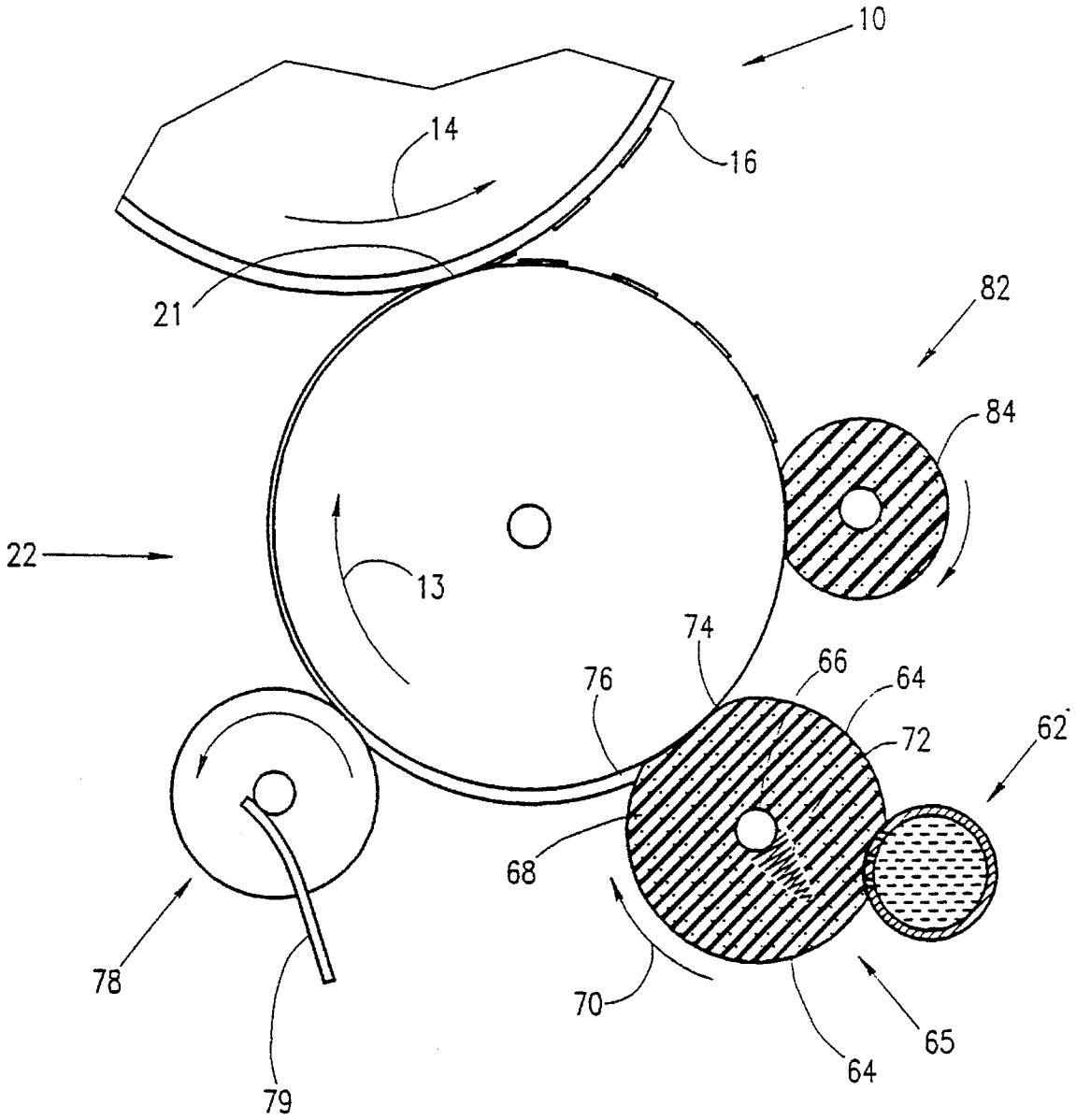
FIG. 2 is a more detailed schematic diagram of a developer assembly constructed and operated in accordance with a preferred embodiment of the present invention.

Reference is made to FIGS. 1 and 2 which illustrate imaging apparatus constructed and operative in accordance with a preferred embodiment of the present invention.

The apparatus includes a drum 10 preferably having a cylindrical photoreceptor surface 16 made of selenium, a selenium compound, an organic photoconductor or any other suitable photoconductor known in the art.

During operation, drum 10 rotates in the direction indicated by arrow 14 and photoreceptor surface 16 is charged by a charger 18 to a generally uniformly predetermined voltage, typically on the order of 1000 volts. Charger 18 may be any type of charger known in the art, such as a corotron, a scorotron or a roller.

Continued rotation of drum 10 brings charged photoreceptor surface 16 into image receiving relationship with an exposure device such as a light source 19, which may be a laser scanner (in the case of a printer) or the projection of an original (in the case of a photocopier). Light source 19 forms a desired latent image on charged photoreceptor surface 16 by selectively discharging a portion of the photoreceptor surface, the image portions being at a first voltage and the background portions at a second voltage. The discharged portions preferably have a voltage of less than about 100 volts.

Continued rotation of drum 10 brings the selectively charged photoreceptor surface 16 into operative contact engagement with a surface 21 of a developer roller 22. Developer roller 22 preferably rotates in a sense opposite that of drum 10, as shown by arrow 13, such that there is substantially zero relative motion between their respective surfaces at the point of contact. Developer roller 22 is most preferably urged against drum 10.

In one embodiment of the invention, developer roller 22 is formed with a metal core coated with, preferably, 1–2 mm of a soft elastomer material having a Shore A hardness of preferably 20–40. In one embodiment of the invention, this coating is made conductive, preferably, to a resistivity between $10^5$ and $10^7$ ohm-cm. In this embodiment, the conductive layer is either covered with a smooth elastomer layer or is formed by casting or other process to have a smooth surface, preferably better than N3.

In a second embodiment of the invention, the soft elastomer material, which may be non-conductive, is coated with a very thin electroconductive layer, such as for example a metal or conducting lacquer layer, which is electrically attached to the metal core. This conductive layer is preferably covered by a thin (preferably 15 to 60 micrometer) layer of conducting polymer having a resistivity, preferably, between $10^7$ to $10^9$ ohm-cm.

Alternatively, drum 10 may be formed of a relatively resilient material, and surface 21 may be composed of either a rigid or compliant material.

As described below, surface 21 is coated with a thin layer of liquid toner, which is preferably very highly concentrated liquid toner. Developer roller 22 itself is charged to a voltage which is intermediate the voltage of the charged and discharged areas on photoreceptor surface 16.

When surface 21 bearing the layer of liquid toner concentrate is engaged with photoreceptor surface 16 of drum 10, the difference in potential between developer roller 22 and surface 16 causes selective transfer of the layer of toner particles to surface 16, thereby developing the latent image. Depending on the choice of toner charge polarity and the use of a "write-white" or "write-black" system as known in the art, the layer of toner particles will be selectively attracted to either the charged or discharged areas of surface 16, and the remaining portions of the toner layer will continue to adhere to surface 21.

When liquid toner having a very high concentration of solids at development is used, as in the preferred embodiments of the present invention, there is little if any electrophoresis and the entire thickness of the layer or a controllable portion of the thickness is transferred to the image areas of the latent image at substantially the same toner concentration as the layer on the developer surface.

In an alternative, especially preferred, embodiment of the invention, the voltage difference between the image portions of the latent image and the developer roller is reduced to a value at which only part of the thickness of the toner concentrate layer is transferred from the developer roller to the image portions of the latent image.

The thickness of the layer that is transferred depends mainly on the charge per unit volume in the layer and depends only slightly on the local thickness or solids concentration of the layer. Thus, even if the layer on the developer roller is not uniform, the layer transferred to the image areas has a uniform DMA and thus a uniform optical density.

This phenomenon is probably due to the following effect: When a voltage is applied across the toner concentrate layer between the development roller and the image areas on the image forming surface, an electric field between the two surfaces is generated. This field is strongest at the image-forming surface and is reduced by the charge in the layer, at points within the layer itself. When a high voltage is applied to the toner concentrate layer, the electric field within the layer is unidirectional, and acts to urge the entire toner layer toward the imaging surface at image regions. When the impressed voltage is low, the electric field may reverse at some point in the layer. For those portions of the layer between this point and the developer roller the electric field actually acts to force the toner particles toward the developer roller.

If the cohesiveness of the layer is not too high, the layer will split at or near this point, with part of the toner layer being transferred to the image-forming surface and part remaining on the developer roller. The amount of solids which is transferred is dependent only on the charge per unit mass in the layer and is not a strong function of the layer thickness or the exact concentration of toner particles in the layer. Thus, development system of the present invention is seen to be substantially less sensitive to variations in application parameters which are difficult to control.

Furthermore, since the DMA is basically directly proportional to the voltage difference applied, the DMA can be easily controlled by changing this voltage. In particular, in a preferred embodiment of the invention, a sensor 100, as known in the art, is placed on the image forming surface downstream of the development region to measure the optical density of the image (and hence the DMA).

The measured value of optical density is then supplied to control electronics 102 which is operative to control a power supply 104 which supplies voltage to developer roller 22.

If the preferred liquid toner of the invention is utilized at a concentration of 25–30% toner particles on the developer layer at a DMA of 0.2 mgm/cm$^2$ (with variations of between about 0.17 and 0.25 mgm/cm$^2$), the transferred layer will preferably be about 0.15 mgm/cm$^2$ with worst case variations of less than ±10%.

In this situation a voltage difference between the image portion and the developer roller of 500–600 volts will result in complete transfer of the layer, while a voltage difference of between 300 and 500 volts will result in the above-described more uniform partial transfer at a process speed of 50 mm/sec.

The use of such partial development dramatically reduces the effect of possible non-uniformities in the toner layer on surface 21. Specifically, the present inventors have found that a layer non-uniformity of approximately ±20 (i.e. a difference of up to ±20% in toner layer density between different areas) on developer surface 21 may be reduced, by using partial development, to a non-uniformity of substantially less than ±10% on the image portions of the latent image on photoreceptor surface 16. For lower initial non-uniformities, for example ±5%, the non-uniformities are reduced to the 1–2% range.

This process results in an image of more uniform density and is especially useful for half-tone imaging in which the image density is to be controlled by the percentage of area to be printed.

Other liquid toner concentrations, as high as 40–50%, with the preferred or other toner materials, can also be used in the practice of the invention for the layer on the developer. For these other toners, other concentrations or for different process speeds, the exact required voltage is determined by experimentation.

For multicolor systems, a plurality of developer rollers may be provided, one for each color, spaced circumferentially around the photoreceptor which are sequentially engaged with photoreceptor surface 16 to develop sequentially-produced latent images.

In a preferred embodiment of the invention, roller 22 is coated by an applicator assembly generally indicated by reference numeral 23. Applicator may be an assembly as shown in more detail in FIGS. 2 and 3, or may be a stationary plate type developer. The toner is coated onto the developer by electrophoresis.

Applicator assembly 23 includes a toner dispenser 62 which can be visualized as having the shape of a flute, i.e. a cylindrical tube having a plurality of holes at different locations along its longitudinal dimension, through which liquid toner is dispensed onto the surface 64 of an applicator roller 65. Applicator 65 is preferably formed of a metal core 66 covered with a relatively thick layer 68 of a resilient open-cell foam (sponge), such as foamed polyurethane, which preferably contains conductive additives. Preferably, the bulk resistivity of the polyurethane (without the holes) is between $10^7$ and $10^9$ ohm-cm. In a preferred embodiment, surface 64 of applicator roller 65 is resiliently urged against surface 21 of developer 22, for example, by virtue of a spring 72 which acts upon the ends of core 66.

As can be seen in FIG. 2, dispenser 62 is preferably forced into applicator roller 65 such that a depression is formed in the outer portion of applicator roller 65, thereby deforming surface 64. The continuous deformation of surface 64 and compression of layer 68 is operative to open cells of layer 68 which may occasionally clog during the operation of developer assembly 23 and the successive release of the deformation is operative to fill the cells. Most of the toner dispensed from dispenser 62 is rapidly absorbed by layer 68 of applicator roller 65, and is homogeneously distributed within layer 68 due to the spongy open-cell structure of the layer and the deformation of the roller. The necessary pressure for dispensing the toner is preferably supplied by a small pump (not shown) which pumps the toner from a toner container (not shown) at a preset pressure. Any suitable pump and any suitable container known in the art may be used for this purpose, as well as any other suitable means for providing the desired toner pressure (such as a pressured tank containing the desired liquid toner). Preferably, surplus toner unabsorbed by layer 68 returns to the container for reuse.

In a preferred embodiment of the present invention, developer roller 22 and applicator roller 65 rotate in the same rotational direction (indicated by arrows 13 and 70 in FIG. 2, respectively), such that their surfaces move in opposite directions. In this embodiment, applicator roller 65 is operative to scrub surface 21 and to remove the residual toner (which normally remains after the selective transfer of toner to surface 16) on surface 21 while applying a new, homogeneous, toner layer to the surface electrophoretically. More specifically, in a preferred embodiment, the absolute velocity of surface 64 is preferably approximately 2–3 times greater than that of surface 21. The relative motion of the applicator and the developer surface is between three to four times the absolute velocity of the developer surface.

In the absence of this scrubbing action and if toner remaining on the developer roller after development of the image is not removed, the DMA on the development roller will be uneven, with up to 30% variations. Furthermore, the toner which remains on the developer roller after development of the image is highly concentrated, and not easily removed, especially if a sponge roller is used for cleaning, so as not to damage surface 21.

For the preferred scrubbing type application, as surfaces 21 and 64 merge into contact at surface merge line 74, the residual toner is scraped off surface 21 by the open cells of surface 64, due to the substantial relative motion between the surfaces and the pressure applied by spring 72. During the relatively long period of surface engagement, the scraped toner is indistinguishably mixed with the new toner carried by surface 64, and a homogeneous layer of toner remains on surface 21 as the surfaces disengage at divergence line 76.

Roller 65 is preferably electrified by a D.C. source, to a different voltage than that of surface 21, in order to induce electrophoretic transfer of toner particles from roller 65 to surface 21. The physical contact between the surfaces is operative more to squeegee and homogenize the applied layer of toner, rather than to apply the layer of toner, which is applied, as aforesaid, by electrophoresis. In general, the solids concentration of the toner rises considerably during the electrostatic application of the toner to surface 21.

In a preferred embodiment of the invention, a liquid toner of 5%–10% solids concentration is supplied by dispenser 62 to roller 65. After application onto the developer roller, the layer has a solids concentration of between 15 and 20 percent.

When a more concentrated toner is supplied by dispenser 62, applicator 65 may further or alternatively be connected to an a.c voltage source, which is operative to somewhat reduce the viscosity of the toner and generally to cause the deposition of a smoother layer on surface 21 of developer roller 22.

In general it is desirable that the liquid toner layer which develops the latent image have as high a solids concentration as possible, preferably 30–50%.

In a preferred embodiment of the invention, developer assembly 23 further includes a squeegee roller 78 in operative contact with roller 22 downstream of dispenser roller 65 and before roller 22 contacts drum 10. Preferably squeegee roller 78 is electrified with a voltage comparable with that of applicator 65, such that the outer surface of the squeegee repels the charged particles of the toner layer on surface 21. Squeegee roller 78 is also preferably resiliently urged against roller 22 such that liquid carrier is removed from the layer as it passes the squeegee roller. The mechanical pressure and the electric repulsion of roller 78 are operative to squeegee the layer of toner, so that the layer is more condensed and uniform as the layer reaches image carrying surface 16. By adjusting the mechanical pressure and by biasing the roller to an appropriate voltage, the concentration of the toner layer can be adjusted to a desirable level.

Thus, in a preferred embodiment, the liquid toner is supplied to roller 78 at a concentration less than that required for optimal development of the latent image. When roller 78 is urged against surface 21 of developer roller 22, it mechanically removes excess toner fluid from the layer impressed on surface 21, and when charged with a suitable electric potential, it repels the charged toner particles and causes them to more closely adhere to surface 21. The excess fluid which has been removed is recovered for reuse. The solids content of the layer is mainly a function of the mechanical properties of the rollers and of the applied voltages and pressures and is only slightly influenced by the initial concentration for a considerable range of initial toner concentrations.

In a preferred embodiment of the invention, squeegee roller 78 comprises an aluminum core which is anodized and coated with a thin layer (approximately 50 micrometers) of polyurethane.

In principle, the system described above does not require that the portions of the toner layer that have not been transferred to drum 10 in the development of the latent image be removed from developer roller 22 between cycles. However, the inventors have found, that the toner uniformity can be further improved if residual toner on the developer roller is removed between coating cycles. For this purpose a cleaning station 82 may be provided, which may comprise a sponge or a brush or similar apparatus, to remove the excess toner concentrate from surface 21 of developer roller 22. The toner so removed may then be pumped back for reuse, after mixture with fresh toner, through dispenser 62 into the sponge of applicator 65.

Cleaning station 82 preferably comprises a sponge roller 84, which is preferably formed of a resilient open cell material similar to that of layer 68 of roller 65. Roller 84 is situated such that it resiliently engages a portion of surface 21 between the transfer area (i.e. the area of surface 21 engaged by surface 16) and the application area (i.e. the area of surface 21 engaged by surface 64), thereby removing residual toner from surface 21 before the application of new toner. In a preferred embodiment of the invention, sponge 84 may be supplied with toner carrier liquid which may assist in cleaning surface 21 by loosening and carrying away the residual toner particles scraped off the surface.

Figure 3:
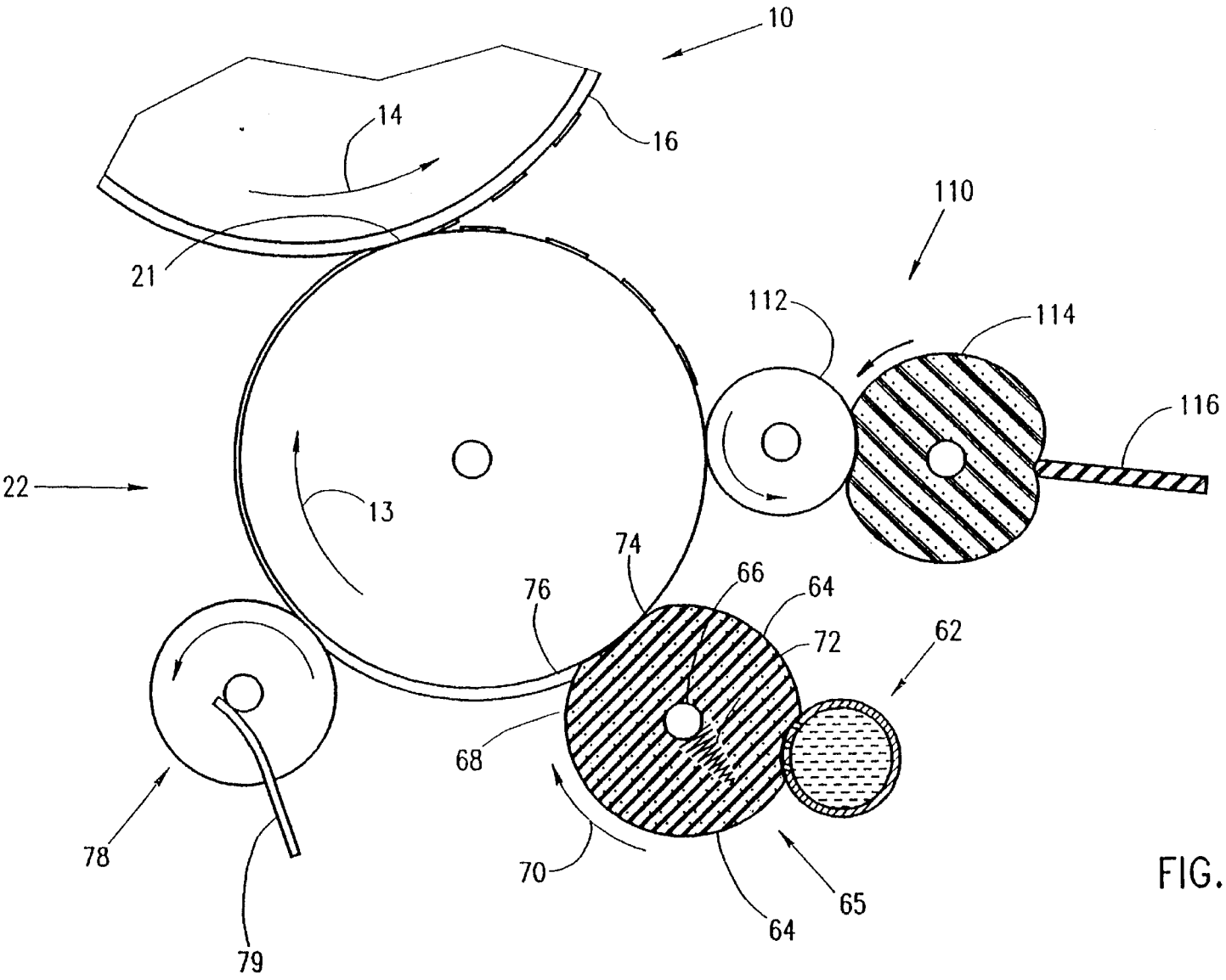
FIG. 3 is a schematic diagram of a developer assembly illustrating an alternative cleaning system in accordance with a preferred embodiment of the invention.

An alternative preferred embodiment of a cleaning system 110, especially suitable for removing residual toner from the developer roller, is shown in FIG. 3. Cleaning 110 comprises a tandem roller arrangement in which a first, biased squeegee, roller 112 removes residual toner particles from developer roller 22 by electrostatic transfer. To this end roller 112 is biased to a voltage that, in conjunction with the developer roller voltage, causes the charged toner particles to be attracted to roller 112. The general construction of roller 112 is preferably, similar to that described above for roller 78.

A second, sponge cleaning, roller 114, removes the toner particles from the biased squeegee roller 112 by abrasion, preferably aided by an electrostatic field. The toner is removed from the sponge roller by a blade 116 which indents the surface of the sponge and scrapes the material which is extruded away. In certain circumstances, depending on the toner material used, one or both of the squeegee-developer or squeegee-sponge surfaces is wetted by a cleaning liquid or dilute toner to aid in transfer and removal of the toner particles.

The toner removed by any of the methods is preferably recycled and used for recoating the developer roller.

It has been found that such cleaning, even if it is not perfect, tends to reduce or eliminate any "memory" effects on the development roller. Cleaning station 82 may be especially useful in the event the toner is of a type which becomes discharged by the electric fields in the interface between the surfaces of developer roller 22 and drum 10.

The latent image developed by means of the process described above may be directly transferred to a desired substrate from the image forming surface in a manner well known in the art. Alternatively, as shown in FIG. 1, there may be provided an intermediate transfer member 40, which may be a drum or belt and which is in operative engagement with photoreceptor surface 16 of drum 10 bearing the developed image. Intermediate transfer member 40 rotates in a direction opposite to that of photoreceptor surface 16, as shown by arrow 43, providing substantially zero relative motion between their respective surfaces at the point of image transfer.

Intermediate transfer member 40 is operative for receiving the toner image from photoreceptor surface 16 and for transferring the toner image to a final substrate 42, such as paper. Disposed internally of intermediate transfer member 40 there may be provided a heater 45, to heat intermediate transfer member 40 as is known in the art. Transfer of the image to intermediate transfer member 40 is preferably aided by providing electrification of intermediate transfer member 40 to provide an electric field between intermediate transfer member 40 and the image areas of photoreceptor surface 16. Intermediate transfer member 40 preferably has a conducting layer 44 underlying an elastomer layer 46, which is preferably a slightly conductive resilient polymeric layer.

Various types of intermediate transfer members are known and are described, for example in U.S. Pat. No. 4,684,238, PCT Publication WO 90/04216 and U.S. Pat. No. 4,974,027, the disclosures of all of which are incorporated herein by reference.

Following the transfer of the toner image to substrate 42 or to intermediate transfer member 40, photoreceptor surface 16 engages a cleaning station 49, which may be any conventional cleaning station. A scraper 56 completes the removal of any residual toner which may not have been removed by cleaning station 49. A lamp 58 then completes the cycle by removing any residual charge, characteristic of the previous image, from photoreceptor surface 16.

The cleaning system shown in FIG. 3 is also used, in a preferred embodiment of the invention, in place of cleaning station 49. In such case, a somewhat softer and more conformal roller is used so as to insure good contact between the squeegee roller 112 and the image forming surface.

In an alternative embodiment of the invention, reversal transfer is used. In this embodiment, the desired image is formed by the areas of toner concentrate which remain on surface 21 of developer roller 22 after the development of photoreceptor surface 16, and developer roller 22 and not drum 10 which is then brought into operative association with an intermediate transfer member or a final substrate so as to obtain a print of the desired image. Any preferred embodiment of the developer assembly described above may also be used in the context of this embodiment.

In a further preferred embodiment of the invention, applicator assembly 65 may be replaced by a curved, electrified plate developer situated parallel to the surface of developer roller at about 6 o'clock on the developer roller. Liquid toner at about 1–10% solids concentration preferably, between 5–10% concentration is fed into the region between the plate and the developer roller and plates the developer roller with a layer having approximately 5–20% toner solids, preferably, 15–20% toner solids. The squeegee roller is then operative to further concentrate the layer to the desired concentration for developing the latent image. In this embodiment, if cleaning station 49 is provided, a toner layer having a ±5% uniformity is presented to the image forming surface.

A preferred, but by no means limiting, liquid toner material for use in the present invention is prepared in the following manner:

Compounding 865.4 g of Surlyn 1605 Ionomer (DuPont), 288.5 g Mogul-L carbon black (Cabot), 28.8 g Endurophtal blue BT583D (Cookson) and 17.3 g aluminum stearate (Merck) are blended for 20 minutes on a two roll mill heated to 150° C. until the blend is homogeneous. The blended material is removed from the mill and shredded in preparation for the next step.

Plasticizing

2 Kg of the blended material and 2 Kg of Marcol 82 (EXXON) are heated for one hour in a double planetary mixer, without mixing. The material is then mixed for 45 minutes at low speed and for 30 minutes at high speed. The material is discharged, while still warm, from the mixer, shredded and ground in a cooled meat grinder in preparation for grinding.

Grinding-Size Reduction 690 g of plasticized material is ground together with 1610 g of Marcol 82 in an attritor charged with 3/16" carbon steel balls. The material is ground at 250 RPM for 30 hours at 55° C.±3° C. The resulting material is diluted to 10% non-volatile solids (NVS) content and screened through a 300 micrometer screen to remove unground particles. Any metalic contaminating material in the toner is removed by magnetic treatment and the resulting material is charged with charge director to form a 10% NVS liquid developer, suitable for the present invention.

It will be appreciated by persons skilled in the art that the present invention is not limited to what has been particularly shown and described hereinabove. Rather, the scope of the present invention is defined only by the claims that follow:

We claim:

1. Imaging apparatus comprising:

an image-forming surface having formed thereon a latent electrostatic image, the latent electrostatic image including image regions at a first voltage and background regions at a second voltage;

a developer surface charged to a third voltage intermediate the first and second voltages and having a second surface urged against and adapted for operative engagement with the image-forming surface at a first, development, region, said developer surface capable of having formed thereon a layer of concentrated liquid toner comprising charged toner particles and carrier liquid;

a developer comprising the developer surface, which develops the latent image, wherein the third voltage is such that less than the total thickness of the layer of concentrated liquid toner is transferred from the developer surface to the image regions of the image-forming surface to form a developed image on the image-forming surface; and means for transferring the developed image from the image-forming surface to a final substrate.

2. Apparatus according to claim 1 wherein the developer comprises a developer roller electrified to a given potential such that the electric field which is produced by the developer roller voltage, the image area voltage and the charge in the toner layer reverses direction within the layer.

3. Apparatus according to claim 2 wherein the voltage difference between the developer roller and the image region is less than 500 volts.

4. Apparatus according to claim 2 wherein the voltage difference between the developer roller and the image region is more than 300 volts.

5. Apparatus according to claim 1 including an applicator assembly for forming the layer of concentrated liquid toner onto the developer surface, the applicator assembly comprising:

an applicator having a moving surface which is urged into resilient engagement with the developer surface at a second, application, region;

a toner dispenser which supplies liquid toner comprising charged toner particles and carrier liquid to the applicator;

a power supply which electrifies the applicator with a voltage such that the electric field formed by the difference in voltage between the developer surface and the applicator in the application region urges the charged toner particles toward the developer surface, forming a layer of charged liquid toner concentrate on the developer surface, wherein the applicator and the developer surface have substantial relative movement at the application region.

6. Imaging apparatus according to claim 5 wherein the concentration of solids in the liquid toner supplied to the applicator assembly is less than 10 percent and the concentration of solids in toned portions of the developed image is at least 25 percent.

7. Imaging apparatus according to claim 5 and further comprising an electrified squeegee roller, which engages the developer surface at a squeegee region situated downstream of the application region and before the development region and squeegees the layer of concentrated liquid toner and increases the concentration of liquid toner therein.

8. Apparatus according to claim 5 and further comprising a cleaning station which removes residual toner from the developer surface after development of the latent image and before application of new toner by the applicator assembly.

9. Apparatus according to claim 8 and wherein the cleaning station comprises a sponge roller which engages with the developer surface at a cleaning region downstream of the development region.

10. Apparatus according to claim 8 wherein the cleaning station comprises;

a squeegee roller urged against the developer surface and biased to a voltage at which the particles are attracted to the squeegee roller; and a sponge roller urged against the squeegee roller and moving at a differential velocity with respect to the adjacent surface of the squeegee roller.

11. Imaging apparatus according to claim 1 wherein the toner dispenser comprises a perforated dispenser tube urged against the applicator at a region remote from the application region.

12. Apparatus according to claim 1 including an applicator assembly which forms the layer of concentrated liquid toner onto the developer surface, the applicator assembly comprising a stationary plate-type developer situated adjacent to the developer surface and includes means for supplying liquid toner to an application region formed between the plate and the developer surface.

13. Apparatus according to claim 1 wherein the concentration of solids in the image portions of the developed image is at least 30 percent.

14. Apparatus according to claim 1 wherein the concentration of solids in the image portions of the developed image is at least 40 percent.

15. Imaging apparatus comprising:

an image-forming surface having formed thereon a latent electrostatic image, the latent electrostatic image including image regions at a first voltage and background regions at a second voltage;

a developer surface charged to a third voltage intermediate the first and second voltages and having a second surface urged against and adapted for operative engagement with the image-forming surface at a first, development, region;

an applicator assembly operative to supply a layer of concentrated liquid toner comprising charged toner particles and carrier liquid onto the developer surface, the applicator assembly comprising:

an applicator having a moving surface which is urged into resilient engagement with the developer surface at an application, region;

a toner dispenser which supplies liquid toner comprising charged toner particles and carrier liquid to the application region;

a power supply which electrifies the applicator with a voltage such that the electric field formed by the difference in voltage between the developer surface and the applicator at the application region urges the charged toner particles toward the developer surface, forming a layer of charged liquid toner concentrate on the developer surface, wherein the applicator and the developer have substantial relative motion at the application region; and wherein the developer surface develops the latent image by transferring at least a portion of the total thickness of the layer of concentrated liquid toner from the developer surface to the image regions of the image-forming surface to form a developed image on the image-forming surface; and means for transferring the developed image from the image forming surface to a final substrate.

16. Apparatus according to claim 15 wherein the applicator is a sponge roller comprised of open cell pores.

17. Apparatus according to claim 15 wherein the applicator and the developer surface move in opposite directions at the application region.

18. Apparatus according to claim 17 wherein the relative motion of the applicator and developer surface is between three and four times the absolute velocity of the developer surface.

19. Apparatus according to claim 15 wherein the relative velocity between the developer surface and the applicator is greater than 150 mm/sec.

20. Cleaning apparatus for removing residual charged liquid toner particles from a moving surface comprising:

a squeegee roller urged against the surface and biased to a voltage at which the particles are attracted to the squeegee roller; and a sponge roller urged against the squeegee roller and moving at a differential velocity with respect to the adjacent surface of the squeegee roller.

21. Apparatus according to claim 20 wherein the sponge roller is biased to a voltage at which the toner particles are attracted thereto.

22. Apparatus according to claim 20 and also including means for supplying a liquid to the interface between the squeegee roller and the surface to be cleaned.

23. Apparatus according to claim 20 and also including means for supplying a liquid to the interface between the squeegee roller and the sponge roller.

* * * * *

UNITED STATES PATENT AND TRADEMARK OFFICE

CERTIFICATE OF CORRECTION

PATENT NO. : 5,610,694

DATED : March 11, 1997

INVENTOR(S) : I. LIOR et al.

It is certified that error appears in the above-indentified patent and that said Letters Patent is hereby corrected as shown below:

On the title page, item [56] and col. 1 change "LATENT DEVELOPMENT APPARATUS FOR USE IN ELECTROPHOTOGRAPHIC IMAGING SYSTEM" to ---LATENT IMAGE DEVELOPMENT APPARATUS FOR USE IN ELECTROPHOTOGRAPHIC IMAGING SYSTEMS---.

At column 11, line 32 (claim 11, line 1), change "claim 1" to ---claim 15---.

Signed and Sealed this

Tenth Day of March, 1998

Bruce Lehman

*Attest:*

BRUCE LEHMAN

*Attesting Officer*

*Commissioner of Patents and Trademarks*